US006180929B1

(12) United States Patent
Pearce

(10) Patent No.: US 6,180,929 B1
(45) Date of Patent: Jan. 30, 2001

(54) HEATING PAD APPARATUS ADAPTED FOR OUTDOOR USE

(75) Inventor: Richard J. Pearce, St. Petersburg, FL (US)

(73) Assignee: Clearpath, Inc., Aurora, CO (US)

( * ) Notice: Under 35 U.S.C. 154(b), the term of this patent shall be extended for 0 days.

(21) Appl. No.: 09/129,965

(22) Filed: Aug. 6, 1998

(51) Int. Cl.[7] ..... H05B 3/34; H05B 1/00
(52) U.S. Cl. ..... 219/528; 219/213
(58) Field of Search ..... 219/528, 520, 219/213, 481, 529, 534, 549

(56) References Cited

U.S. PATENT DOCUMENTS

| | | | | |
|---|---|---|---|---|
| 3,806,702 | * | 4/1974 | Spencer | 219/528 |
| 3,878,362 | * | 4/1975 | Stinger | 219/528 |
| 3,900,654 | | 8/1975 | Stinger . | |
| 4,335,299 | * | 6/1982 | Belohlavek | 219/510 |
| 4,429,216 | * | 1/1984 | Brigham | 219/528 |
| 4,485,297 | | 11/1984 | Grise et al. . | |
| 4,564,745 | | 1/1986 | Deschenes . | |
| 4,646,818 | * | 3/1987 | Ervin | 165/703 |
| 4,656,339 | * | 4/1987 | Grise | 219/528 |
| 4,689,474 | * | 8/1987 | Overbergh et al. | 219/528 |
| 4,733,057 | * | 3/1988 | Stanzel et al. | 219/548 |
| 4,892,998 | | 1/1990 | Marstiller et al. . | |
| 4,967,057 | * | 10/1990 | Bayless et al. | 219/213 |
| 5,003,157 | * | 3/1991 | Haregrove | 219/213 |
| 5,233,164 | * | 8/1993 | Dicks et al. | 219/528 |
| 5,591,365 | * | 1/1997 | Shields | 219/213 |
| 5,605,418 | | 2/1997 | Watanabe et al. . | |
| 5,614,292 | | 3/1997 | Saylor . | |
| 5,637,247 | | 6/1997 | Flynn, Jr. . | |
| 5,686,005 | * | 11/1997 | Wright | 219/549 |
| 5,786,563 | * | 7/1998 | Tiburzi | 219/213 |
| 5,854,470 | * | 12/1998 | Silva | 219/528 |

* cited by examiner

*Primary Examiner*—Teresa Walberg
*Assistant Examiner*—Daniel Robinson
(74) *Attorney, Agent, or Firm*—Dennis G. LaPointe; Mason & Associates, PA

(57) ABSTRACT

A lightweight flexible electrical heating device for melting snow and ice that may be cut in the field to custom length. The device includes a planar flexible electric heater sandwiched between two vulcanized polymer protective sheets. The heater include an array of resistive heating elements electrically connected in parallel and oriented substantially across the device length, allowing the heater to be cut to any length as needed. Potentially the outside surfaces is equipped with a ribbed non skid pattern that form an array of ribs and channels to increase traction and aid in water drainage.

29 Claims, 3 Drawing Sheets

HEATING PAD APPARATUS ADAPTED FOR OUTDOOR USE

FIELD OF THE INVENTION

This invention relates to flexible electrical heating pads and more specifically to a flexible-heating pad adapted for outdoor use for melting snow and ice accumulations.

BACKGROUND OF THE INVENTION

Over the years there have been a number of attempts to melt snow and ice accumulations by heating the affected surface. Most past configurations required a permanent installation of the heating element inside the surface, as exemplified by Watanabe in U.S. Pat. No. 5,605,418 and Deschenes in U.S. Pat. No. 4,564,745. These solutions however tend to be expensive, are not readily adaptable to existing surfaces, and maintenance and repair often require destruction and reconstruction of the protected surface.

Several attempts at melting snow and ice accumulations by placing a heater on the surface of the area to be cleared have been made, as discussed below. Bayless et al. U.S. Pat. No. 4,967,057 teaches the use of multiple individual panels to cover varying size areas. The Bayless patent however calls for multiple connections between the separate panels, presenting potential failure points Additionally the panel may be dislocated and/or disconnected when driven upon. . The invention also requires a large number of panels to cover large areas and thus is less fitting for installation on driveways.

Another attempt by Shields, in U.S. Pat. No. 5,591,365 addresses those concerns by placing the heating element in a flexible lattice form. However the Shields invention uses a single series resistive element in the form of specialized and expensive heating cable distributed throughout the lattice. The use of a single series heating element prevents field customization of the heater to fit varying length of protected areas, and reduces reliability since a break in any point along the heater will render the whole apparatus inoperative.

Similar patents include Saylor in U.S. Pat. No. 5,614,292, Hargrove in U.S. Pat. No. 5,003,157, Spencer in U.S. Pat. No. 3,806,702, and Flynn Jr. in U.S. Pat. No. 5,637,247.

Patents such as U.S. Pat. No. 3,900,654 to Stinger have described heater elements allowing trimming to any desired length, comprising a thin, flexible laminated assembly of electrically conductive elastomeric material. In U.S. Pat. No. 4,523,085 Grise teaches a Flexible sheet film heating elements that comprises current feed electrodes, heretofore referred to as bus bars, disposed in parallel along two sides of the heater film. Multiple resistive ink patterns traversly connect between the bus bars to form an array of parallel connected heater elements. This arrangement allows for field customization of the heater length since the film heater may be cut anywhere between the parallel connected heating elements. However the Grise heater is not durable enough to sustain people or vehicular traffic or prolonged exposure to elements such as ultraviolet light ozone and other chemicals. Additionally when cut, the Grise heater does not offer submersion protection since the bus bars are exposed at the cut end.

All the above, taken individually or in combination do not teach the current invention as claimed. An inexpensive solution to the problem of snow removal by electrical means that is easy to install by untrained personnel, and that may be sold in roll form to allow cutting for any desired length in the field is therefor clearly highly desirable and is presented in the instant invention.

SUMMARY OF THE INVENTION

It is an object of the current invention to provide a safe, easy to install heating pad, primarily for de-icing and snow melting on driveways, walkways, stairs, ramps, rooftops and other similar surfaces requiring snow and ice removal. It is another object of the invention to create an environmentally sealed heating pad that may be exposed to the elements for an extended periods of time while applied to objects and surfaces requiring protection from snow and ice accumulations. It is yet another object of the invention to provide a heating pad which can easily be rolled up and stowed when not required.

Yet another object of the invention is to provide a heating pad for melting snow and ice that is easy to install, and can be field adjustable for application to driveways, stairs, ramps, rooftops, walkways and pathways of varying lengths. It is also an object of the invention to increase the traction of said driveways, ramps, walkways or pathways protected by the invention, and facilitate water drainage therefrom.

The present invention provides for flexible continuous heating pad comprising lower and upper abrasion resistant protective layers, and having a flexible electrical heater disposed therebetween. The upper and lower abrasion resistant layers protect the heater from the elements, provide environmental and mechanical protection to the heater, and make it durable enough to sustain frequent vehicular and human traffic. Thus the invention creates a portable heating pad easily applied to various surfaces to prevent ice and snow accumulations.

The present invention more specifically is a heating device for melting snow and ice which comprises a planar flexible electric heater including a plurality of resistive heating elements connected electrically in parallel and having two opposite planar surfaces. The device further includes at least two protective sheets composed of abrasion resistant flexible material, each having an inner surface oriented towards and in face to face adherent engagement with a respective planar surface of the plurality of resistive heating elements. The two protective sheets and electric heater disposed between the sheets form a heater assembly having two opposing end edges, and two opposing side edges. The electric heater further includes an elongated, flexible, electrically insulating substrate having an electrically insulated surface, and an electrical conductor disposed in proximity to each of the respective opposing side edges. The plurality of resistive heating elements includes a plurality of resistive material traces deposited on the substrate in spaced apart relationship, each of the traces being in electrical communication with the electrical conductors and extending therebetween. The respective inner surfaces of the protective sheets are laminated and bonded onto respective planar surfaces of the electric heater. Another embodiment is to mold the electric heater between said two protective sheets. At least one of the protective sheets includes an outer surface with a nonskid pattern impressed thereupon. A thermal cutout switch is preferably electrically connected in series with said electric heater for stopping the heating pad operation when the ambient temperature is above a predetermined level. Also included is an elongated sealing bracket having a substantially 'U' cross section forming an elongated opening dimensioned to receive the end edge of the heater assembly within the opening to protect the end edge from the environment and hazards due to submersion in water and of course, to prevent injury due to shock. The elongated sealing bracket is attached with sealing means for bonding the end edge of the heater assembly and for encapsulating the end edge. Positional stability is preferably enhanced with securing means such as tie downs or stakes located near the perimeter of the device. A benefit of the present invention is that the opposing side edges can be shaped to accommodate a curved walkway or driveway, or a walkway around a hot tub or similar curved area where snow and ice accumulation is nondesirous.

The heater is composed of an array of resistive heating elements electrically connected in parallel to each other. The heating elements generally traverse the longitudinal axis of the heater and thus the heater, and therefor the heating pad, may be cut to size in the field along a line separating the individual resistive elements.

It will be seen that the construction of the current invention allows for continuous production in roll form. This allows shipping and selling the invention in roll form and allows the customer to purchase only the needed amount of heating device to cover the area in need of protection.

DETAILED DESCRIPTION INVENTION

Figure 1:
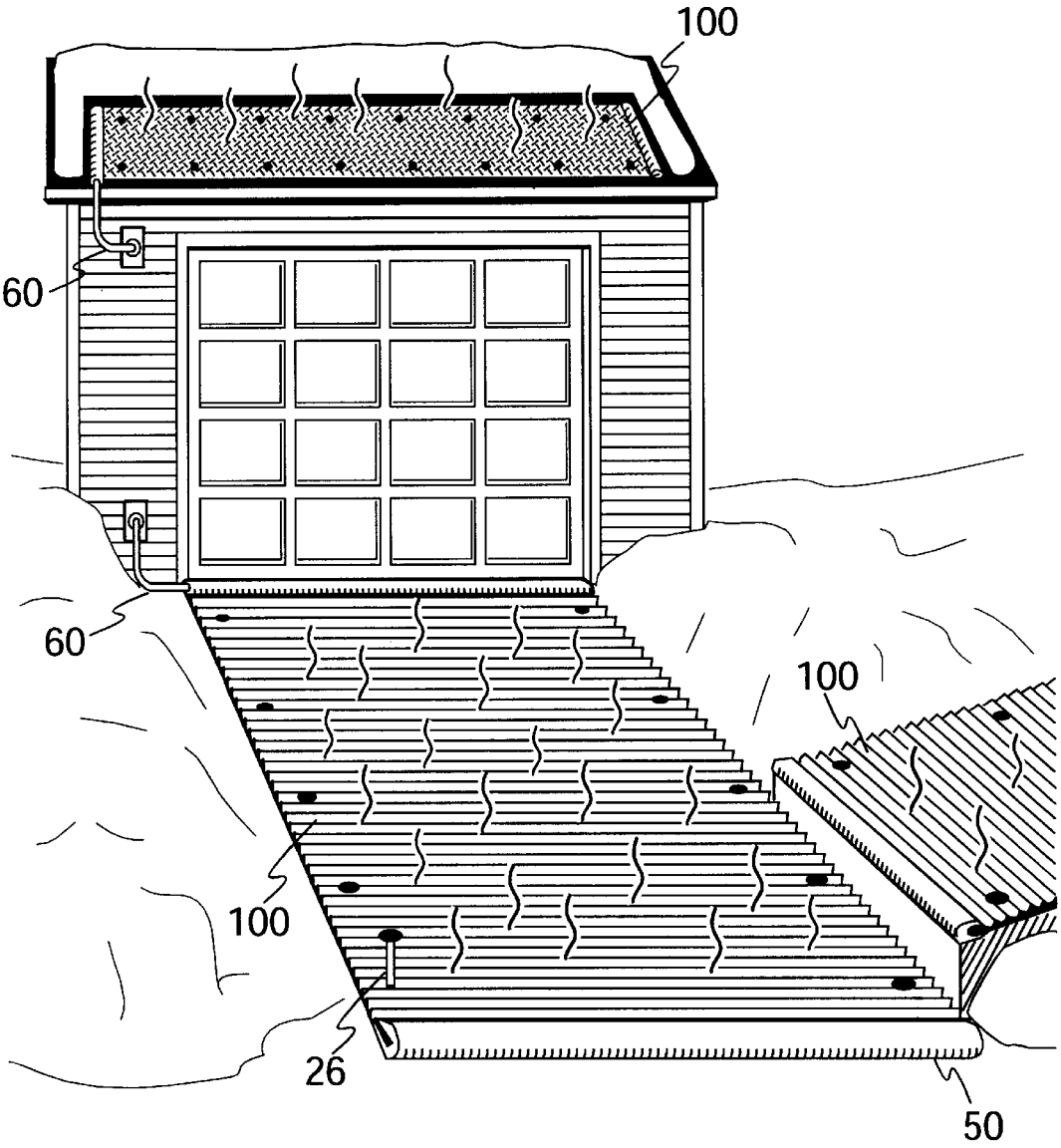
FIG. 1 presents an isometric view of three possible application of the invention.
Figure 2:
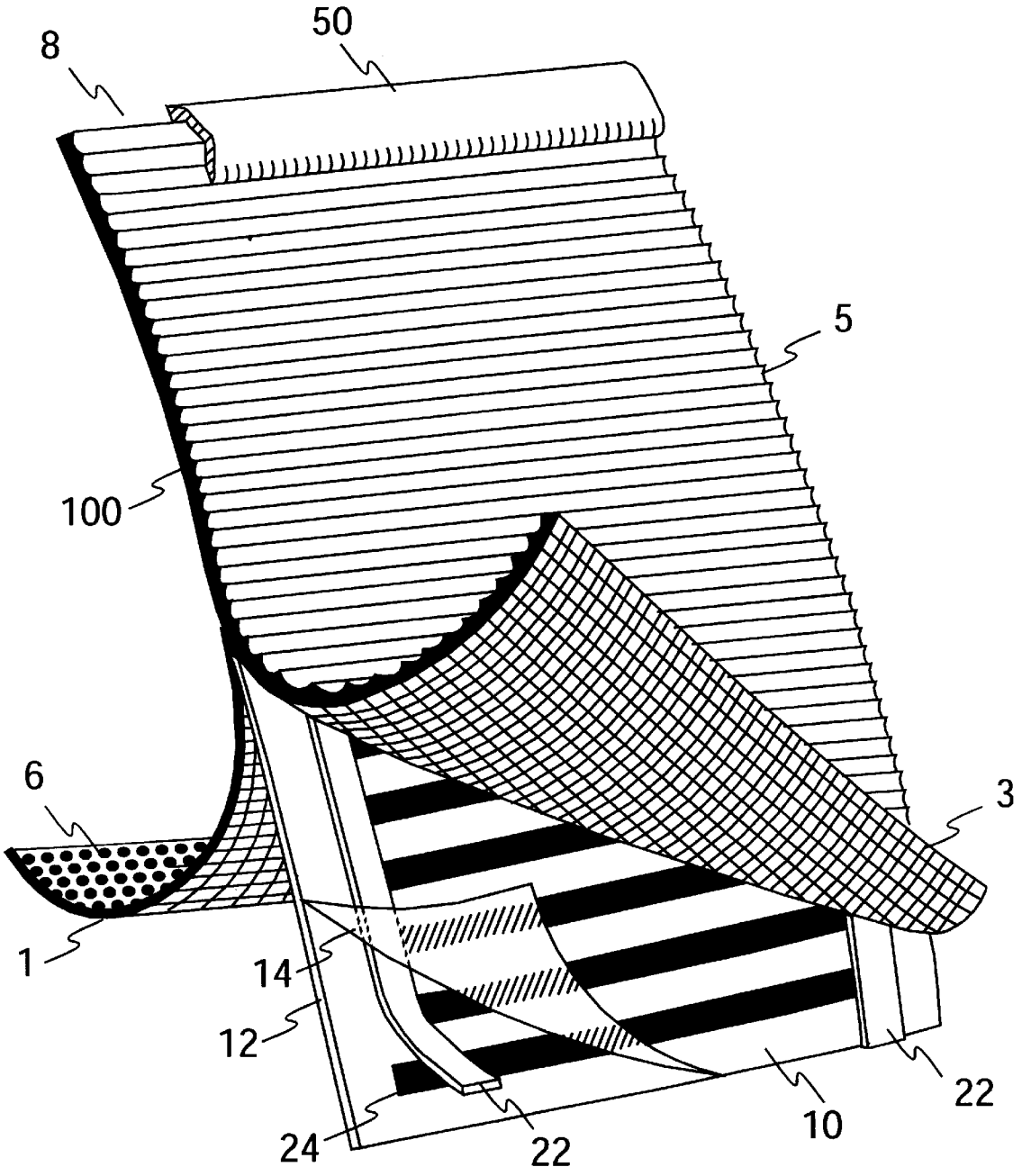
FIG. 2 presents partially exploded view of the preferred embodiment showing construction details.

FIG. 1. Shows three possible applications of the heating device 100 depicted in the current invention, deployed on a driveway, a pathway and on a rooftop.

The first preferred embodiment of the invention comprises a lower protective layer 1 and an upper protective layer 3 in face to face relationship to each other and having a flexible film heater, generally marked 10, disposed therebetween.

Figure 3:
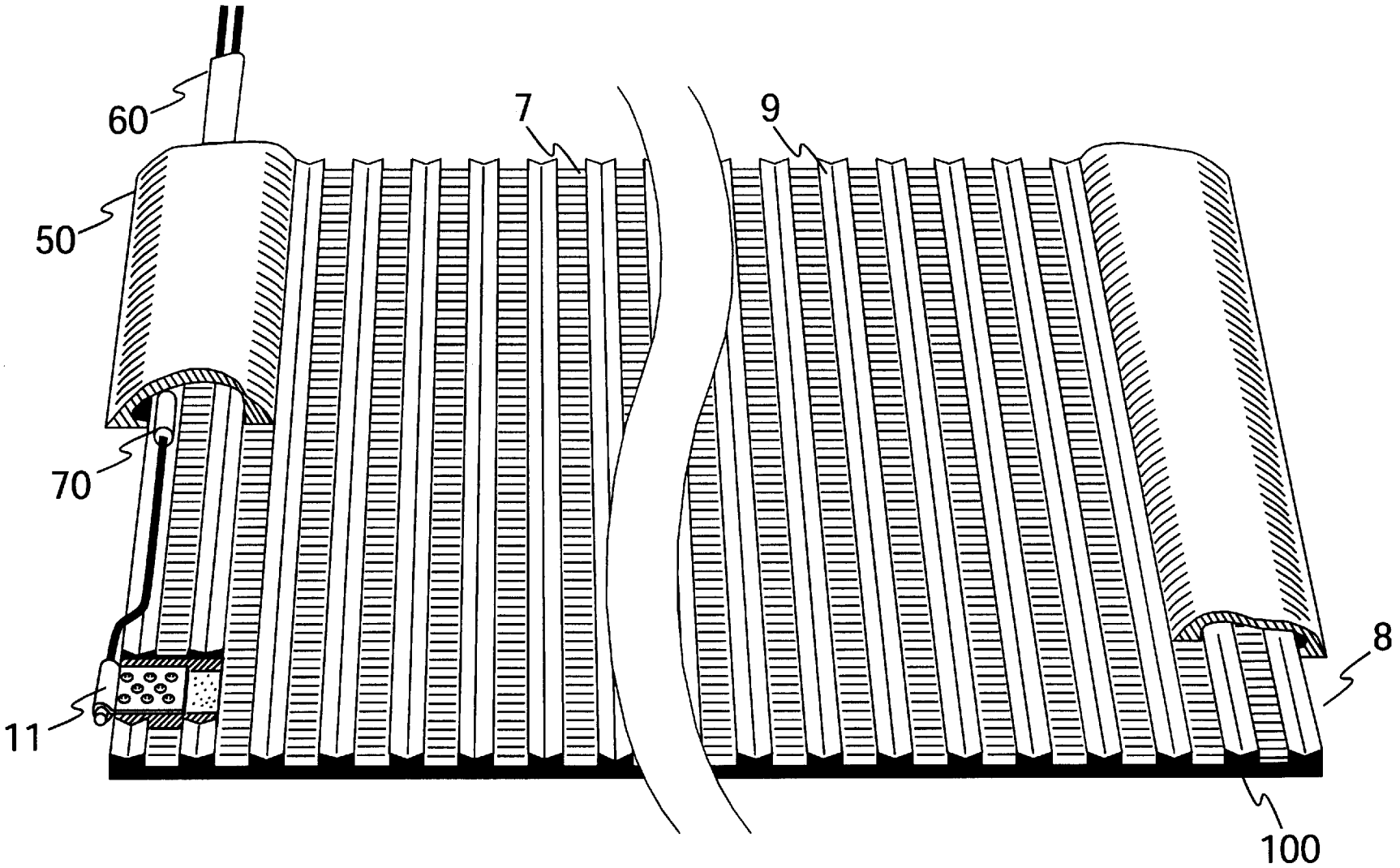
FIG. 3 presents a detailed expanded view of the ends of the invention, showing sealing and connection details.

The heater 10 comprises an elongated bottom sheet to act as a substrate sheet 12, and an elongated top plastic sheet to act as a cover sheet 14. The substrate and the cover sheets are made of thin film of flexible electrically insulating polymeric material such as polyester or kepton© (commercially available from Du-Pont, Wilmington, Del.). Two flat copper electrical conductors or electrodes 22 are disposed in parallel near the opposite edges of the heater to act as bus bars. A pattern comprising multiple resistive traces 24, electrically connected to the bus bars and extending therebetween in regularly spaced intervals, is printed upon the substrate sheet 12 using resistive ink. Each of the resistive traces 24 forms an independent resistive heating element electrically connected by the bus bars to the other resistive traces to form an array of resistive heating elements connected in parallel. When electric power generally a 110 volt or 220 volt household circuit, is applied to the bus bars, as depicted in FIG. 3 by electrical connector 11, the array of resistive heating elements form a heater. Since the resistive heating elements are all connected in parallel, elements may be removed, i.e. by cutting the heating device 100 along a line separating the resistive traces 24, without significant change to the power density, i.e. the power dissipation per unit area of the pad. The parallel connection provides the additional advantage of fault tolerance, wherein the heater 10 will continue to operate even with some of its resistive traces 24 disconnected. Multiple heating devices 100 can be attached to each other to form an array to sufficiently cover a driveway, walkway or roof area. The array of devices 100 are electrically interconnected with power cord 60, FIG. 3, using weathertight plug and receptacle connections (not shown) generally known in the art.

In the preferred embodiment, the lower protective layer 1 and upper protective layer 3 are formed of elastic, fiber reinforced rubber or rubber-like vulcanized polymer laminated to both sides of the film heater 10. The protective layers 1 and 3, seals and protects the heater 10 from exposure to the elements and provides mechanical strength and durability. The different layers, 1, 3 and 10 are laminated to each other to form the heater assembly. It should be noted that other methods such as molding the heater within the protective layers, gluing, ultra sonic welding and other methods known in the art can be deployed to affix or bond the heater to the upper and lower protective layers.

The outer surface of the upper protective layer 3 is provided with non-skid texture 5. Optionally, as in FIG. 3, multiple drain channels 7 are formed on said upper protective layer 3 to facilitate water drainage away from the heated surface. In the preferred embodiment the texture comprises a plurality of spaced-apart raised strips or ribs 9, generally oriented across the longitudinal axis of the heating pad, in a direction perpendicular to the intended traffic direction. The strips or ribs are about 6 mm in height, and have a 'V' groove on top to provide excellent traction. The spaces between the strips form drainage channels 7 to drain water away from the heating pad surface.

Optionally, the lower protective layer 1 is also provided with non skid texture 6 so as to increase friction when the pad surface and help prevent dislocation of the heating pad by traffic. Additionally securing means such as stakes 26 may be driven through the edges of the heating pad or cords attached to the heating pad may be used to further secure the heating pad to the surface to be protected from snow and ice and provide positional stability.

A generally U shaped sealing bracket 50 is attached with sealing means such as glues or other bonding means which will provide a seal, to the cut end 8 of the heating pad to seal the end against submersion and exposure from to weather related hazards as well as to prevent injury due to electrocution. The bracket 50 may also serve to protect connection terminals and wiring to the heating pad. Optionally the sealing bracket is filled with a sealant (e.g. Room temperature vulcanization silicon rubber) applied between the heating pad cut end and the bracket, to provide a better seal as well as for fixing the bracket 50 to the end of the heating pad 8.

The preferred embodiment also includes a thermal cutout switch 70 connected in series with the heater to protect against temperature rise above a predetermined level, e.g. 12° C. Optionally, the switch 70 is also utilized to stop the heating pad operation when the ambient temperature is above a selected level.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A heating device for melting snow and ice comprising:

a planar flexible electric heater including a plurality of resistive heating elements connected electrically in parallel and having two opposite planar surfaces; and at least two protective sheets composed of abrasion resistant flexible material, each having an inner surface oriented towards and in face to face adherent engagement with a respective planar surface of the plurality of resistive heating elements, said two protective sheets and electric heater disposed therebetween forming a heater assembly having two opposing end edges, and two opposing side edges and wherein the resistive heating elements run entirely perpendicular to electrical conductors that are parallel to the side edges, and both are electrically interconnected such that a portion of the heating device may be removed to accommodate a use by cutting the heating device between selected individual resistance heating elements, the heating device being adapted to maintain its electrical operative characteristics.

2. The heating device according to claim 21 wherein said electric heater further comprises:

an elongated, flexible, electrically insulating substrate having an electrically insulated surface; and an electrical conductor disposed in proximity and parallel to each of said respective opposing side edges, wherein said plurality of resistive heating elements comprises a plurality of resistive material traces deposited on said substrate in spaced apart relationship, each of said traces being in electrical communication with and entirely perpendicular to said electrical conductors and extending therebetween, and wherein resistive heating traces and electrical conductors are arranged such that a portion of the heating device may be removed to accommodate a use by cutting the heating device between selected individual resistive heating traces, the heating device being adapted to maintain its electrical operative characteristics.

3. The heating device according to claim 1 wherein the respective inner surfaces of said protective sheets are laminated onto respective planar surfaces of said electric heater.

4. The heating device according to claim 1 wherein the respective inner surfaces of said protective sheets are bonded onto respective planar surfaces of said electric heater.

5. The heating device according to claim 1 wherein said electric heater is molded between said two protective sheets.

6. The heating device according to claim 1 wherein at least one of said protective sheets includes an outer surface with a nonskid pattern impressed thereupon.

7. The heating device according to claim 1 further comprising a thermal cutout switch electrically connected in series with said electric heater.

8. The heating device according to claim 1 further comprising an elongated sealing bracket having a substantially 'U' cross section forming an elongated opening dimensioned to receive the end edge of said heater assembly within said opening to protect the end edge.

9. The heating device according to claim 8 wherein the elongated sealing bracket is attached with sealing means for bonding the end edge of the heater assembly and for encapsulating the end edge thereby preventing submersion, exposure from weather hazards, and injury due to electrocution.

10. A heating device for melting snow and ice comprising:

a planar flexible electric heater having two opposite planar surfaces;

the electric heater including an elongated, flexible electrically insulating substrate having an electrically insulated surface and two opposite edges;

the electric heater further including an electrical conductor disposed in proximity and parallel to each of said opposite edges, and a plurality of resistive material traces deposited on said substrate in spaced apart relationship, each trace being in electrical engagement with said electrical conductors and extending therebetween to form an array of heating elements connected electrically in parallel;

at least two elongated protective sheets composed of elastic abrasion resistant flexible material, each having an inner surface oriented towards and in face to face adherent relationship with a respective planar surface of the flexible electric heater, said protective sheets and array of heater elements disposed therebetween forming a heater assembly having two opposing end edges and two opposing side edges; and an elongated sealing bracket having a substantially 'U' cross section forming an elongated opening dimensioned to receive the crosswise edge of said heater assembly within said opening to protect the crosswise edge from submersion, exposure from weather hazards, and to prevent injury due to electrocution, wherein resistive heating traces are entirely perpendicular to electrical conductors and are arranged such that a portion the heating device may be removed to accommodate a use by cutting the heating device between selected individual resistive heating traces, the heating device being adapted to maintain its electrical operative characteristics.

11. The heating device according to claim 10 wherein at least one of said protective sheets includes an outer surface having a plurality of ribs protruding therefrom to form a nonskid pattern.

12. The heating device according to claim 11 wherein said plurality of ribs are elongated in spaced apart relationship, and extend substantially transversely to the side edges of the heater assembly, the ribs further forming drainage channels in the spaces therebetween.

13. The heating device according to claim 10 wherein the elongated sealing bracket is attached with sealing means for bonding the end edge of said heater assembly and for encapsulating said end edge thereby preventing submersion, exposure from weather hazards and injury due to electrocution.

14. A heating device for melting snow and ice comprising:

an upper protective rubber sheet;

a bottom protective rubber sheet; and an electric heater including a plastic sheet insulating substrate having a plurality of resistive traces imprinted upon said substrate in spaced apart relationship, the traces being electrically connected in parallel by two spaced apart conductive electrodes disposed in proximity and parallel to each edge of said substrate, and the resistive traces forming a parallel array of connected heating elements, wherein said electric heater is disposed in face to face adherent relationship between the upper protective sheet and the bottom protective sheet to form a heater assembly having two opposing end edges and two opposing side edges, and wherein resistive heating traces are entirely perpendicular to conductive electrodes and are arranged such that a portion of the heating device may be removed to accommodate a use by cutting the heating device between selected individual resistive heating traces, the heating device being adapted to maintain its electrical operative characteristics.

15. The heating device according to claim 14 wherein at least one of said protective sheets includes a plurality of ribs protruding therefrom to form a nonskid pattern.

16. The heating device according to claim 15 wherein the plurality of ribs are elongated in spaced apart relationship and extend substantially transversely to the side edges of said heater assembly, the ribs further forming drainage channels in the spaces therebetween.

17. The heating device according to claim 14 further comprising an elongated sealing bracket having a substantially 'U' cross section forming an elongated opening dimensioned to receive the end edge of said heater assembly within said opening to protect the end edge from submersion, exposure from weather hazards, and to prevent injury due to electrocution.

18. The heating device according to claims 1, 10 or 14 wherein at least one of said protective sheets is reinforced by fibrous material embedded therein.

19. The heating device according to claim 1, 10, or 14 further comprising means for securing and for providing positional stability of the heating device on a surface to be protected from snow and ice.

20. A heating device for melting snow and ice comprising:

a planar flexible electric heater including a plurality of resistive heating elements connected electrically in parallel and having two opposite planar surfaces;

the electric heater further including an elongated, flexible, electrically insulating substrate having an electrically insulated surface and an electrical conductor disposed in proximity to each of said respective opposing side edges, the plurality of resistive heating elements being resistive material traces deposited on said substrate in spaced apart relationship, each of said traces being in electrical communication with said electrical conductors and extending therebetween; and at least two protective sheets composed of abrasion resistant flexible material, each having an inner surface oriented towards and in face to face adherent engagement with a respective planar surface of the plurality of resistive heating elements, said two protective sheets and electric heater disposed therebetween forming a heater assembly having two opposing end edges, and two opposing side edges, wherein resistive heating traces are entirely perpendicular to electrical conductors and are arranged such that a portion of the heating device may be removed to accommodate a use by cutting the heating device between selected individual resistive heating traces, the heating device being adapted to maintain its electrical operative characteristics.

21. The heating device according to claim 20 wherein the respective inner surfaces of said protective sheets are laminated onto respective planar surfaces of said electric heater.

22. The heating device according to claim 20 wherein the respective inner surfaces of said protective sheets are bonded onto respective planar surfaces of said electric heater.

23. The heating device according to claim 20 wherein said electric heater is molded between said two protective sheets.

24. The heating device according to claim 20 wherein at least one of said protective sheets includes an outer surface with a nonskid pattern impressed thereupon.

25. The heating device according to claim 20 further comprising a thermal cutout switch electrically connected in series with said electric heater.

26. The heating device according to claim 20 further comprising an elongated sealing bracket having a substantially 'U' cross section forming an elongated opening dimensioned to receive the end edge of said heater assembly within said opening to protect the end edge.

27. The heating device according to claim 26 wherein the elongated sealing bracket is attached with sealing means for bonding the end edge of the heater assembly and for encapsulating the end edge thereby preventing submersion, exposure from weather hazards, and injury due to electrocution.

28. The heating device according to claim 20 wherein at least one of said protective sheets is reinforced by fibrous material embedded therein.

29. The heating device according to claim 20 further comprising means for securing and for providing positional stability of the heating device on a surface to be protected from snow and ice.

* * * * *

UNITED STATES PATENT AND TRADEMARK OFFICE

CERTIFICATE OF CORRECTION

PATENT NO. : 6,180,929 B1
DATED : January 30, 2001
INVENTOR(S) : Richard J. Pearce It is certified that error appears in the above-identified patent and that said Letters Patent is hereby corrected as shown below:

Column 7,
Line 27, after "proximity" insert -- and parallel --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*